US010533326B2

(12) United States Patent
Owens

(10) Patent No.: US 10,533,326 B2
(45) Date of Patent: Jan. 14, 2020

(54) PLASTER TAPING APPARATUS AND ATTACHMENTS

(71) Applicant: PHAANIX PTY LTD, Newtown, Victoria (AU)

(72) Inventor: Daniel Luke Owens, Newtown (AU)

(73) Assignee: PHAANIX PTY LTD, Victoria (AU)

( * ) Notice: Subject to any disclaimer, the term of this patent is extended or adjusted under 35 U.S.C. 154(b) by 0 days.

(21) Appl. No.: 15/792,726

(22) Filed: Oct. 24, 2017

(65) Prior Publication Data

US 2019/0119931 A1 Apr. 25, 2019

(51) Int. Cl.

| | |
|---|---|
| ***E04F 21/16*** | (2006.01) |
| ***E04F 21/08*** | (2006.01) |
| ***E04F 13/06*** | (2006.01) |
| ***E04F 21/165*** | (2006.01) |
| ***E04F 13/04*** | (2006.01) |
| ***E04F 21/00*** | (2006.01) |

(52) U.S. Cl.

CPC ..... *E04F 21/16* (2013.01); *E04F 13/068* (2013.01); *E04F 21/08* (2013.01); *E04F 21/1657* (2013.01); *E04F 13/042* (2013.01); *E04F 21/0084* (2013.01)

(58) Field of Classification Search

CPC .... E04F 21/026; E04F 21/165; E04F 21/1657
See application file for complete search history.

(56) References Cited

U.S. PATENT DOCUMENTS

| | | | | |
|---|---|---|---|---|
| 4,196,028 A * | 4/1980 | Mills | B44C 7/06 156/523 |
| 4,197,624 A | 4/1980 | Lass | |
| 4,451,223 A | 5/1984 | Mower et al. | |
| 5,114,527 A * | 5/1992 | Stern | B44C 7/04 118/413 |

(Continued)

FOREIGN PATENT DOCUMENTS

WO WO 2014202853 A1 * 12/2014 ..... E04F 21/00

OTHER PUBLICATIONS

Amanton, "WO 2014/202853, machine translation", published Dec. 24, 2014.*

(Continued)

*Primary Examiner* — Alex B Efta
(74) *Attorney, Agent, or Firm* — Kinney & Lange, P.A.

(57) ABSTRACT

A plaster taping apparatus comprises a compartment for holding plaster taping mix and receiving a supply of tape and a removable attachment attachable to the plaster taping apparatus for applying the tape comprising the plaster taping mix exiting the compartment to a surface. The removable attachment comprises a body having a mounting member attachable to a clip arrangement on an outer wall of the compartment. The body comprises a first wheel arrangement at or towards a first end of the body for applying the tape to flat joints and a second wheel arrangement at or towards a second end of the body for applying the tape to internal joints. The plaster taping apparatus comprises an adjustment lever or dial accessible when the removable attachment is (Continued)

attached to the plaster taping apparatus for adjusting a thickness of the plaster taping mix coating the tape.

28 Claims, 12 Drawing Sheets

(56) References Cited

U.S. PATENT DOCUMENTS

| | | | | |
|---|---|---|---|---|
| 5,814,184 | A * | 9/1998 | Denkins | B65H 35/0033 156/577 |
| 6,540,002 | B1 * | 4/2003 | Edwards | B44C 7/06 156/574 |
| 8,955,573 | B2 * | 2/2015 | Owens | E04F 21/00 156/574 |
| 2003/0066611 | A1 * | 4/2003 | Gunn | B65H 35/0053 156/575 |
| 2010/0288443 | A1 * | 11/2010 | Tucker | E04F 13/04 156/577 |

OTHER PUBLICATIONS

Liard. Uploaded Jun. 22, 2017. "Banjo Zunder delko France Europe". Retrieved from https://www.youtube.com/watch?v=sxWSHWH3eTY.*

* cited by examiner

PLASTER TAPING APPARATUS AND ATTACHMENTS

TECHNICAL FIELD

The present invention relates to plaster taping apparatus and attachments therefor. In particular, although not exclusively, the present invention relates to hand tools and attachments for coating tape with plaster mix or the like and applying such coated tape to joints between plasterboard, drywall and the like.

BACKGROUND

Drywall taping tools are used to simultaneously apply tape and plaster mix or the like over drywall joints when finishing the wall surface. Such tools are commonly referred to as banjo taping machines, plaster taping banjos or mud boxes. Such taping tools typically comprise a compartment for storing the plaster mix, a holder for holding a roll of the tape and a blade or wheel arrangement comprising one or more wheels at a front end which presses the tape comprising the plaster mixture dispensed from the tool over the joint.

In some taping tools, the wheel arrangement comprises one or more serrated rollers which are limited to applying tape to a joint over a flat surface and cannot be used to access and apply the tape to internal corner joints. Therefore, a tradesman must apply the tape and plaster to the internal corner joints by hand which is awkward and laborious.

There have been many hand-held tools developed with angled surfaces or rollers for facilitating the smoothing of the plaster tape along an internal corner joint. However, these tools must be used as a secondary tool after the plaster tape has been applied to the wall, which is time consuming.

With reference to U.S. Pat. No. 8,955,573, the inventor for the present application addressed these issues by developing an attachment for connecting to taping tools, which facilitates the smoothing of the plaster tape along an internal corner joint. The attachment can be used with the same taping tool used for taping flat joints. Two attachments are still however required for applying tape to flat joints and to internal joints. Therefore, an attachment for applying tape to flat joints must be typically unscrewed and removed from the plaster taping device and the attachment for applying tape along an internal corner joint screwed into place.

Other plaster taping banjos are heavy and/or cumbersome to use and/or can be difficult to clean after use, which can impair the operation during subsequent use.

One object of the present disclosure is to provide an improved plaster taping apparatus and/or accessory therefor that addresses or at least ameliorates one or more of the aforementioned problems and/or provides a useful commercial alternative.

SUMMARY

Generally, embodiments of the present invention relate to plaster taping apparatus and accessories therefor. In particular, embodiments of the present invention relate to a plaster taping apparatus comprising a removable attachment comprising a first wheel arrangement for applying tape to flat joints and a second wheel arrangement for applying tape to internal joints.

In one form, although not necessarily the broadest or only form, the present invention resides in a plaster taping apparatus comprising:

a compartment for holding plaster taping mix and receiving a supply of tape;

a removable attachment attachable to the plaster taping apparatus for applying the tape comprising the plaster taping mix exiting the compartment to a surface;

wherein the removable attachment comprises a first wheel arrangement for applying the tape comprising the plaster taping mix to flat joints and a second wheel arrangement for applying the tape comprising the plaster taping mix to internal joints.

In another form, although not necessarily the broadest form, the present invention resides in a removable attachment for a plaster taping apparatus, the attachment comprising:

a first wheel arrangement for applying tape to flat joints and a second wheel arrangement for applying tape to internal joints.

Preferably, the plaster taping apparatus comprises a tape holder for holding a supply of tape. Suitably, the tape holder is coupled to the compartment. Preferably, the tape holder comprises a hub for receiving a roll of tape and the hub is rotatably mounted on an axle.

Preferably, the compartment comprises a first aperture for receiving the tape and a second aperture for dispensing tape comprising the plaster taping mix.

Preferably, a size of the second aperture is adjustable to vary a thickness of plaster taping mix coating the tape.

Suitably, the size of the second aperture is adjustable by movement of a blade. Suitably, a position of the blade is adjustable within a predetermined range of positions. Suitably, the position of the blade is adjustable between a plurality of discrete predetermined positions.

Preferably, the size of the second aperture is adjustable by movement of an adjustment lever or dial coupled to the blade, wherein the adjustment lever or dial is accessible when the removable attachment is attached to the plaster taping apparatus.

Preferably, the plaster taping apparatus comprises a cover hingedly attached to one or more walls of the compartment for providing access to and for sealing the compartment.

Suitably, at least one of the one or more walls of the compartment and/or the cover comprises one or more handles for using and/or carrying the plaster taping apparatus.

Preferably, at least one of the one or more walls of the compartment comprises a clip arrangement for slidably receiving the removable attachment and securing the removable attachment in position relative to the plaster taping apparatus.

Preferably, the removable attachment comprises a body with the first wheel arrangement at or towards a first end of the body and the second wheel arrangement at or towards a second end of the body.

Suitably, the body comprises a mounting member which is slidably received in the clip arrangement of the plaster taping apparatus.

Suitably, the removable attachment is attached to the plaster taping apparatus in a first orientation for applying tape to flat joints and attached to the plaster taping apparatus in a second orientation for applying tape to internal joints. Suitably, the second orientation is 180 degrees relative to the first orientation.

Suitably, the body comprises a first elongate portion and a second elongate portion, wherein the first elongate portion is angled relative to the second elongate portion.

Preferably, the first wheel arrangement for applying tape to flat joints comprises an axle rotatably mounted at or towards the first end of the body, the axle supporting a central disc and a serrated disc on either side of the central disc and spaced apart therefrom, the serrated discs of the first wheel arrangement being of the same or a similar diameter as the central disc.

Preferably, the second wheel arrangement for applying tape to internal corner joints comprises an axle rotatably mounted at or towards the first end of the body, the axle supporting a central disc and a serrated disc on either side of the central disc and spaced apart therefrom, the serrated discs of the second wheel arrangement being of a smaller diameter than the central disc.

Preferably, a periphery of the central disc of the second wheel arrangement comprises a v-shaped profile.

Preferably, the serrated discs of the first and second wheel arrangements are mounted external of the body.

Preferably, the central discs of the first and second wheel arrangements are mounted at least partially internally of the body.

Further forms and/or features of the present invention will become apparent from the following detailed description.

BRIEF DESCRIPTION OF THE DRAWINGS

In order that the invention may be readily understood and put into practical effect, reference will now be made to preferred embodiments of the present invention with reference to the accompanying drawings, wherein like reference numbers refer to identical elements. The drawings are provided by way of example only, wherein.

Figure 1:
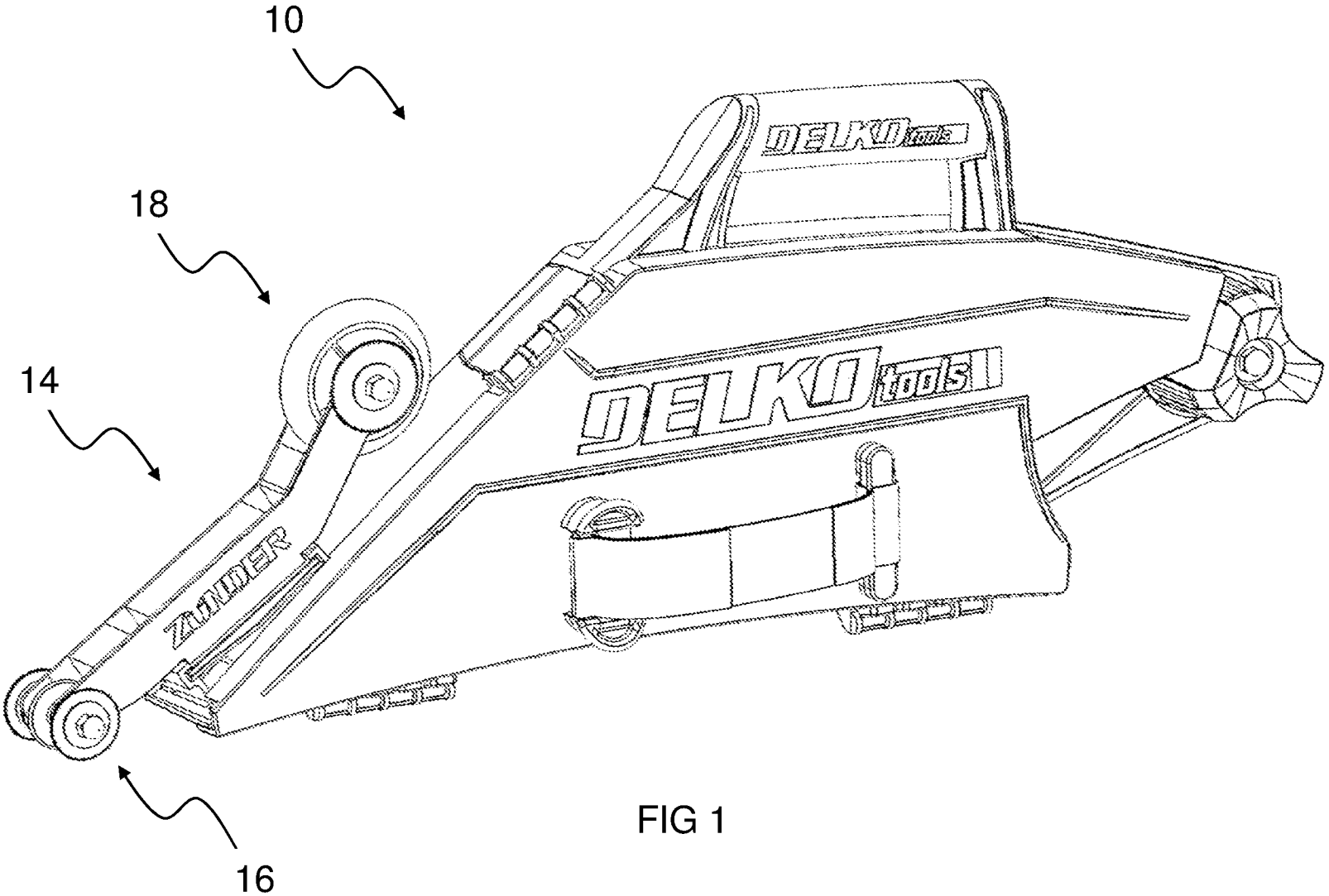
FIG. 1 is a right side perspective view of a plaster taping apparatus and attachment according to embodiments of the present invention.

Skilled addressees will appreciate that elements in the drawings are illustrated for simplicity and clarity and have not necessarily been drawn to scale. For example, the relative dimensions of some of the elements in the drawings may be distorted to help improve understanding of embodiments of the present invention.

DETAILED DESCRIPTION OF THE PREFERRED EMBODIMENTS

Embodiments of the present invention relate to plaster taping apparatus and accessories therefor. In particular, embodiments of the present invention relate to a plaster taping apparatus comprising a removable attachment comprising a first wheel arrangement for applying tape to flat joints and a second wheel arrangement for applying tape to internal joints such that only a single attachment is required to apply tape comprising plaster mix to both flat joints and internal joints.

Figure 2:
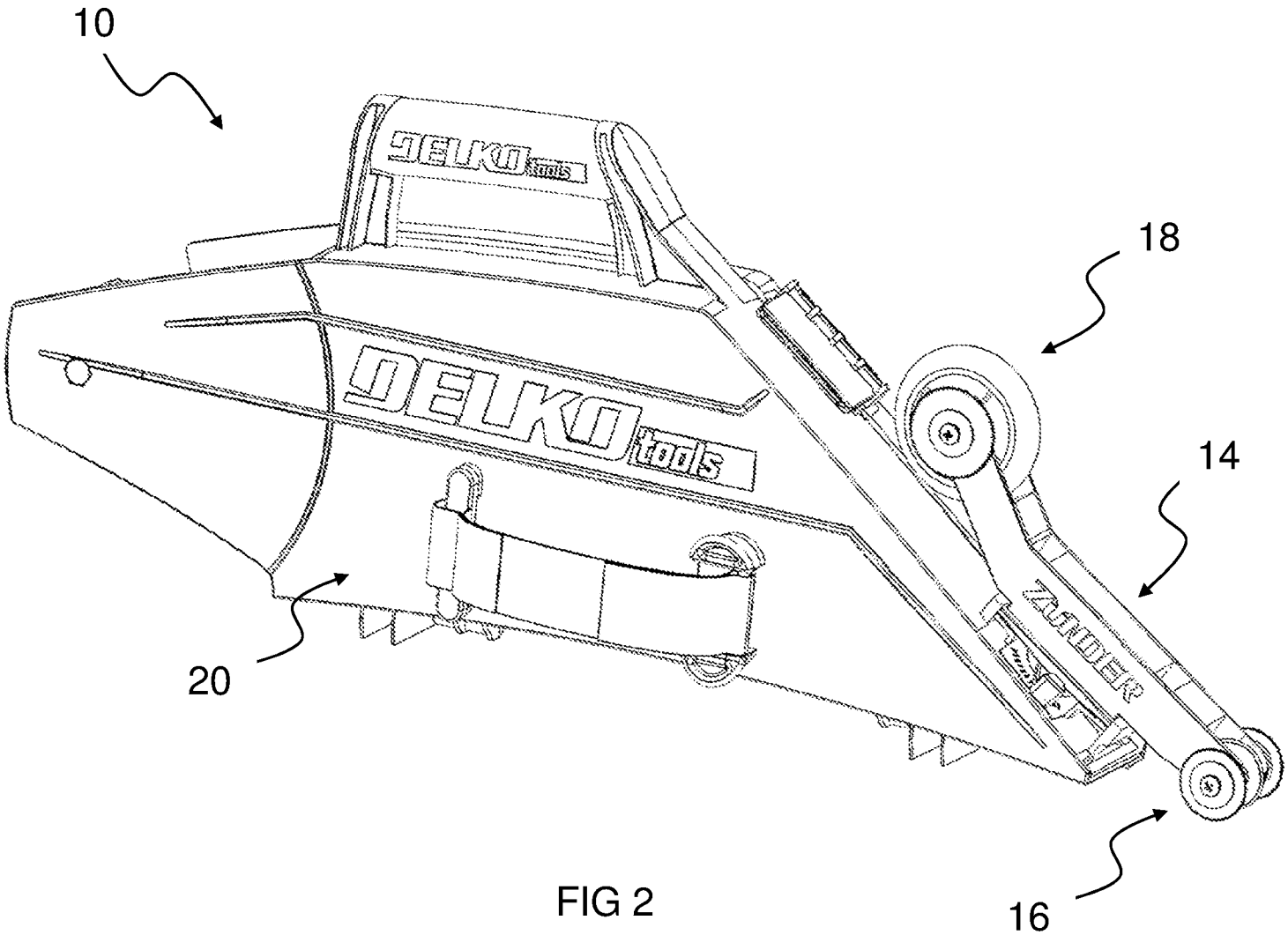
FIG. 2 is a left side perspective view of the plaster taping apparatus and the attachment shown in FIG. 1.
Figure 3:
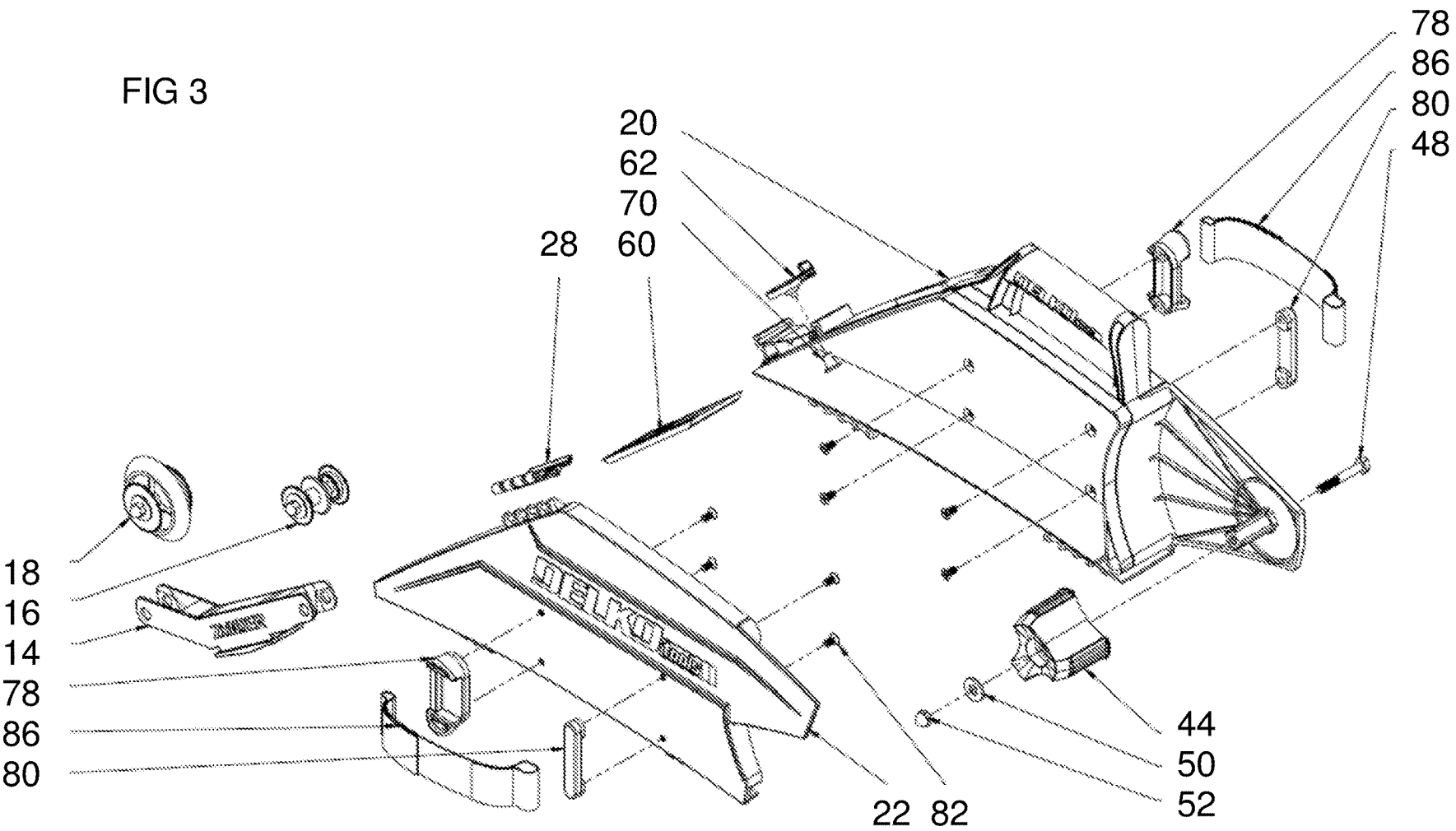
FIG. 3 is an exploded view of the plaster taping apparatus and the attachment shown in FIG. 1.

With reference to FIGS. 1 to 3, a plaster taping apparatus 10 according to embodiments of the present invention comprises a compartment 12 for holding plaster taping mix and for receiving a supply of tape. A removable attachment 14 is attachable to the plaster taping apparatus 10 for applying tape comprising the plaster taping mix exiting the compartment 12 to a surface, such as drywall, plasterboard or the like to cover a joint between two pieces thereof. The removable attachment 14 comprises a first wheel arrangement 16 for applying the tape to flat joints and a second wheel arrangement 18 for applying the tape to internal joints, such as internal corner joints.

The plaster taping apparatus 10 comprises a body 20 having the cavity or compartment 12 for holding plaster taping mix or plaster taping mud. A cover 22 is hingedly attached to one or more walls of the compartment for providing access to and for sealing the compartment 12. In some embodiments, the cover 22 is hingedly attached to an inwardly curved lower wall 24 of the compartment 12 via two spaced apart hinges 26. The cover 22 is secured in a closed position via a hinged clip 28 which releasably engages with a ridge 30 extending from a sloping upper wall 32 of the compartment 12.

Sloping upper wall 32 extends from near the lower wall 24 and joins with a second outwardly curved upper wall 34. An inwardly curved end wall 36 extends from the second upper wall 34 toward the lower wall 24. A side wall 38 opposite the cover 22 abuts the lower wall 24, sloping upper wall 32, second upper wall 34 and curved end wall 36 thus forming the open compartment 12 that is sealed by the cover 22.

The plaster taping apparatus 10 comprises a tape holder 40 for holding a supply of tape, which is typically provided in the form of a roll of tape. According to some embodiments, the tape holder 40 is coupled to the compartment 12, for example via an extension of the body 20 in the form of a tape supporting arm 42. In preferred embodiments, the tape holder 40 comprises a hub 44 for receiving the roll of tape and the hub 44 is rotatably mounted on a hollow axle 46. The hub 44 is rotatably secured on the axle 46 via a fastener, such as a thread cap screw 48 which passes through the hollow axle 46, a washer 50 and a cap nut 52. The tape supporting arm 42 can comprise one or more webs or gussets 54 extending between the axle 46 and the curved end wall 36 and/or between the axle 46 and the perimeter of tape supporting arm 42 for added strength and integrity of the tape supporting arm 42.

The curved end wall 36 extends from the second upper wall 34 toward the lower wall 24, but does not join the lower wall 24 such that the compartment 12 comprises a first aperture 56 for receiving the tape from the tape holder 40. Sloping upper wall 32 extends to but does not join the lower wall 24 such that the compartment 12 comprises a second aperture 58 for dispensing the tape comprising the plaster taping mix. Tape is fed through the first aperture 56 into the compartment 12 and is placed adjacent or substantially adjacent the inner faces of the curved end wall 36, the second upper wall 34 and the sloping upper wall 32 and is fed out through the second aperture 58.

The plaster taping mix is typically of a pourable consistency and the desired volume of mix can be simply poured into the compartment 12 once the tape is at least approximately in place in the compartment 12. According to some embodiments, the compartment 12 can accommodate about 2.2 litres or about 2.5 kg of plaster taping mix, but the invention is not limited to this volume/amount. The flowable plaster taping mix pushes the tape against the inner faces of the curved end wall 36, the second upper wall 34 and the sloping upper wall 32 such that the tape is coated with the plaster taping mix when it exits the second aperture 58. The plaster taping mix coats the tape on a side facing the surface to which the tape will be applied.

Figure 3C:
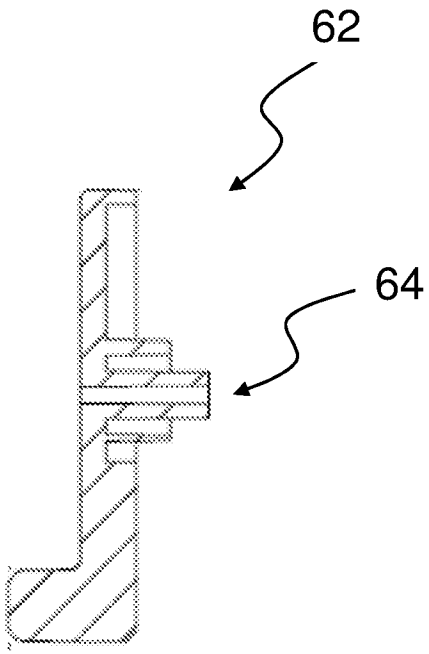
FIG. 3C is a sectional view of the adjustment lever or dial shown in FIG. 3A along line A-A.
Figure 3B:
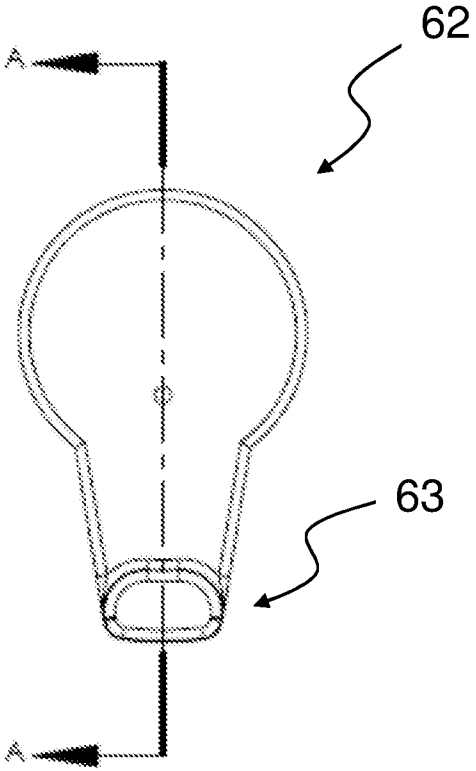
FIG. 3B is a front view of the adjustment lever or dial shown in FIG. 3A.
Figure 3A:
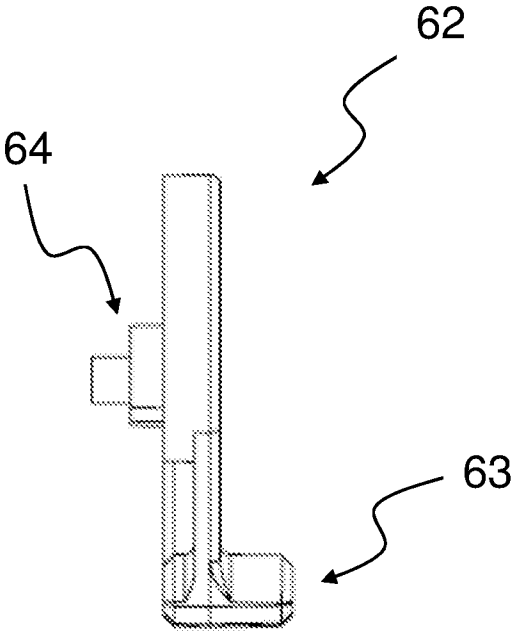
FIG. 3A is a side view of an adjustment lever or dial of the plaster taping apparatus shown in FIG. 1.
Figure 6:
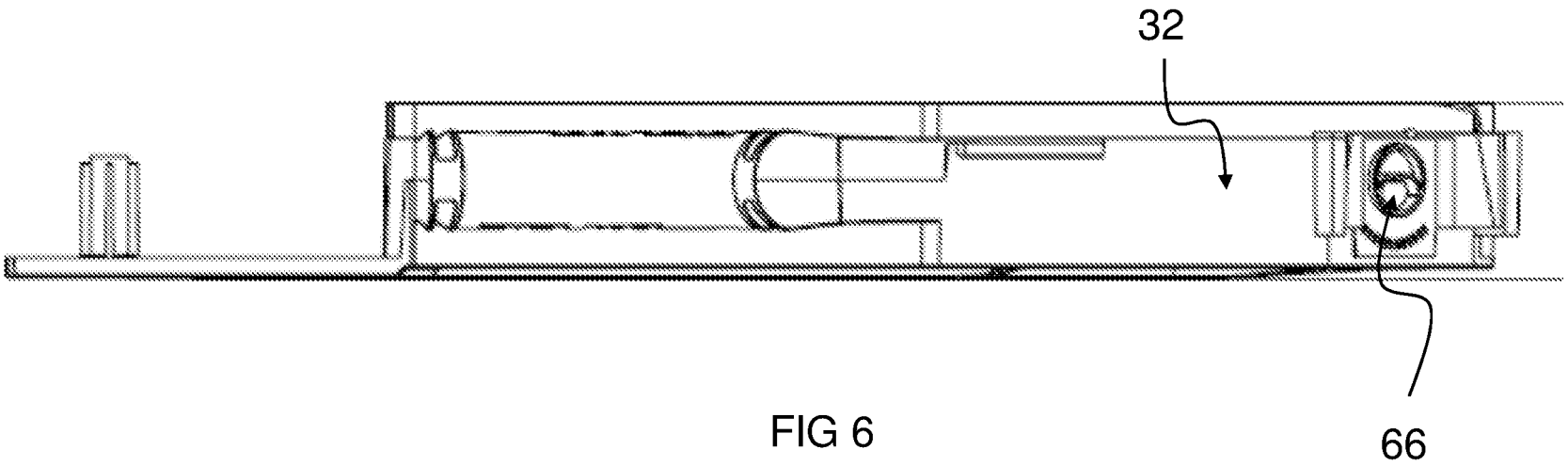
FIG. 6 is a plan view of a compartment of the plaster taping apparatus shown in FIG. 1 showing an aperture in an upper sloping side for receiving part of an adjustment lever or dial.

A size of the second aperture 58 is adjustable to vary a thickness of the plaster taping mix coating the tape. According to some embodiments, the size of the second aperture 58 is adjustable by movement of a blade 60, shown in FIGS. 3, 7, 8 and 9. According to some embodiments, the size of the second aperture 58 is adjustable by movement of an adjustment lever or dial 62 coupled to the blade 60. With additional reference to FIGS. 3A-3C, the adjustment lever or dial 62 comprises a tab 63 extending from a front face to facilitate movement of the lever or dial 62 and a projection 64 extending from a rear face which extends through an aperture 66 (shown in FIG. 6) in the sloping upper wall 32 when the adjustment lever or dial 62 is in position. The blade 60 comprises a slot or cut-out 68 for receiving an adjustment pin 70 therethrough. The projection 64 of the adjustment lever or dial 62 is received within the adjustment pin 70 to secure the blade 60 in position adjacent an inner face of the sloping upper wall 32 inside the compartment 12. The position of an inclined edge 72 of the blade 60 relative to an inner face of the lower wall 24 determines the size of the second aperture 58 and thus the thickness of the plaster taping mix coating the tape. A position of the blade 60, and thus the inclined edge 72, is adjustable within a predetermined range of positions. In some embodiments, the position of the blade 60 is adjustable between a plurality of discrete predetermined positions.

In some embodiments, the blade 60 comprises an inclined edge 72 at each end such that the blade 60 is reversible. In such embodiments, the slot or cut-out 68 is provided centrally on the blade 60.

The adjustment lever or dial 62 is accessible when the removable attachment 14 is attached to the plaster taping apparatus 10. Therefore, the thickness of the plaster taping mix coating the tape can be adjusted when the removable attachment 14 is attached and the plaster taping apparatus 10 is in use.

Figure 4:
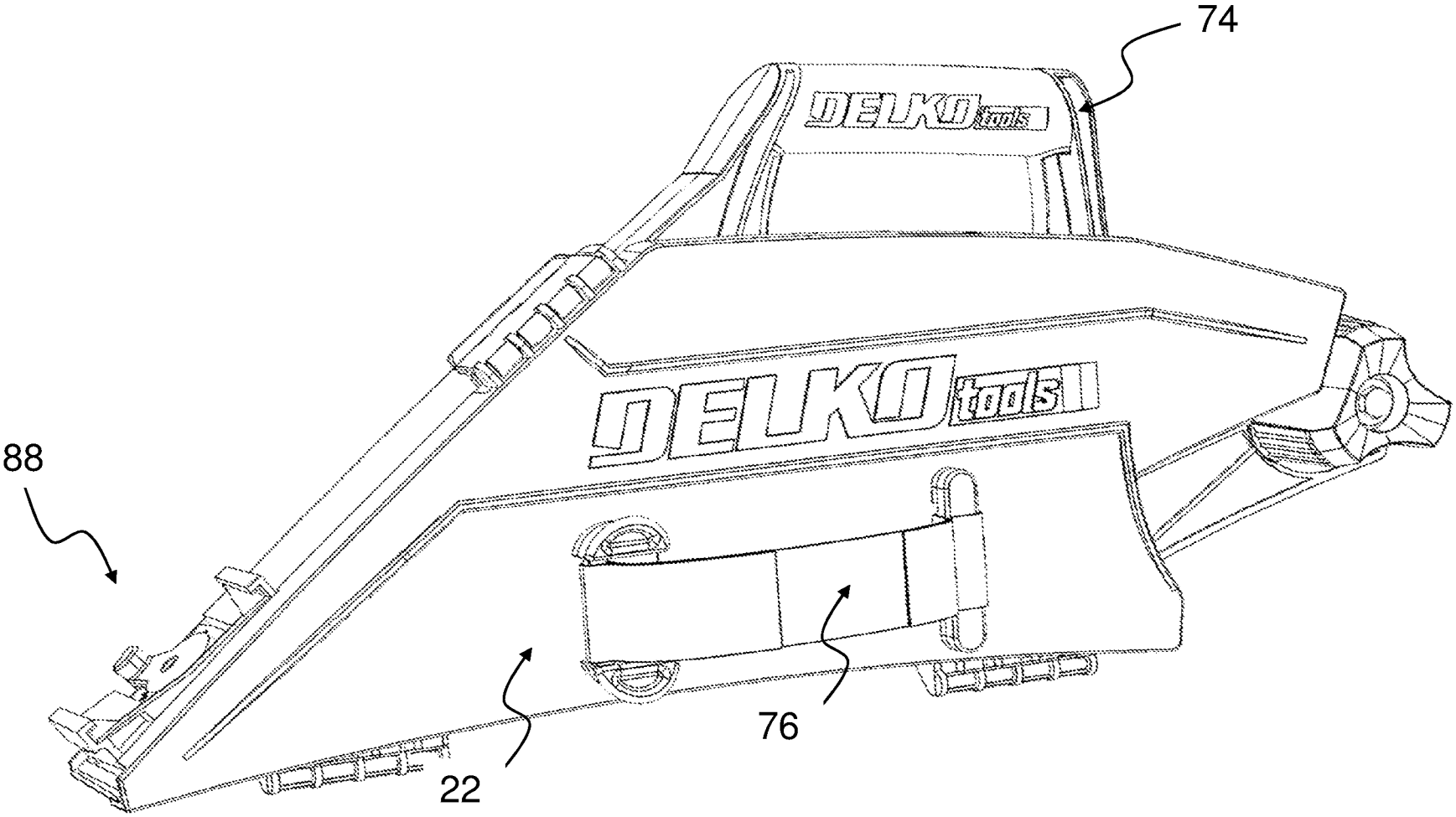
FIG. 4 is a right side perspective view of the plaster taping apparatus shown in FIG. 1 without the attachment attached thereto.
Figure 5:
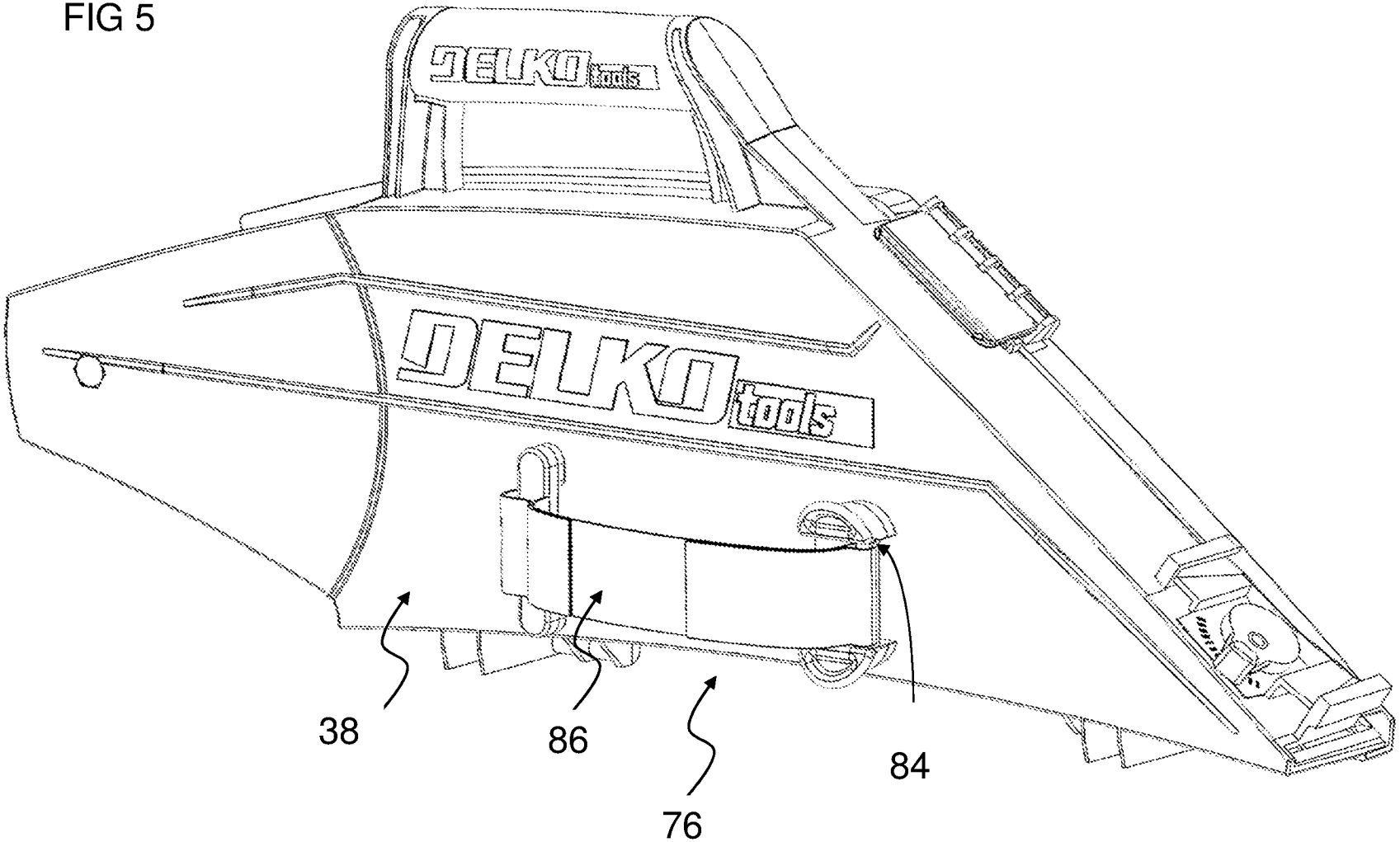
FIG. 5 is a left side perspective view of the plaster taping apparatus shown in FIG. 1 without the attachment attached thereto.

With additional reference to FIGS. 4 and 5, according to preferred embodiments, at least one of the walls of the compartment 12 and/or the cover 22 comprises one or more handles for using and/or carrying the plaster taping apparatus 10. For example, a handle 74 extending from, or otherwise coupled to the second upper wall 34 can be provided which is particularly suited to carrying the plaster taping apparatus 10. Handles 76 extending from, or otherwise coupled to the cover 22 and/or the side wall 38 opposite the cover 22 can be provided which are particularly suited to for gripping by a user of the plaster taping apparatus 10. Handles 76 comprise a first mount 78 and a second mount 80 that are attached to the outside of the side wall 38 and the outside of the cover 22 by any suitable means, such as screws 82 which are countersunk in the inside of the side wall 38 and in the inside of the cover 22. The first mount 78 comprises a bar 84 around which a first end of a strap 86 is attached. A second end of the strap is attached around the second mount 80. In some embodiments a length of the strap 86 is adjustable to suit different hand sizes.

Figure 11:
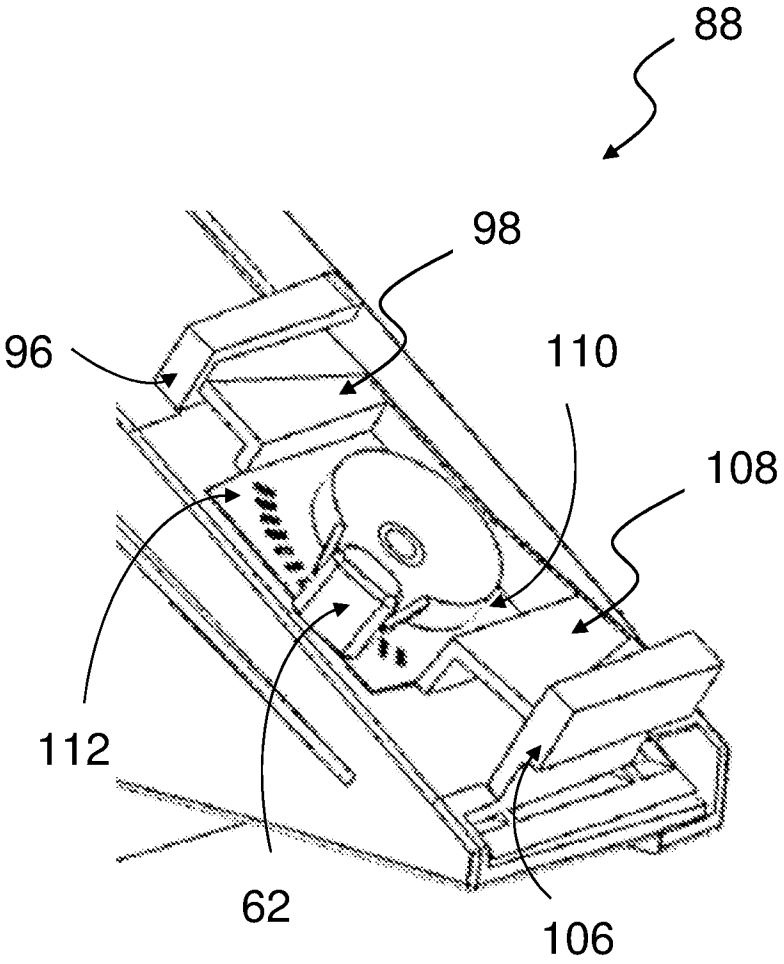
FIG. 11 is an enlarged view of the clip arrangement of the plaster taping apparatus shown in FIG. 5.
Figure 10:
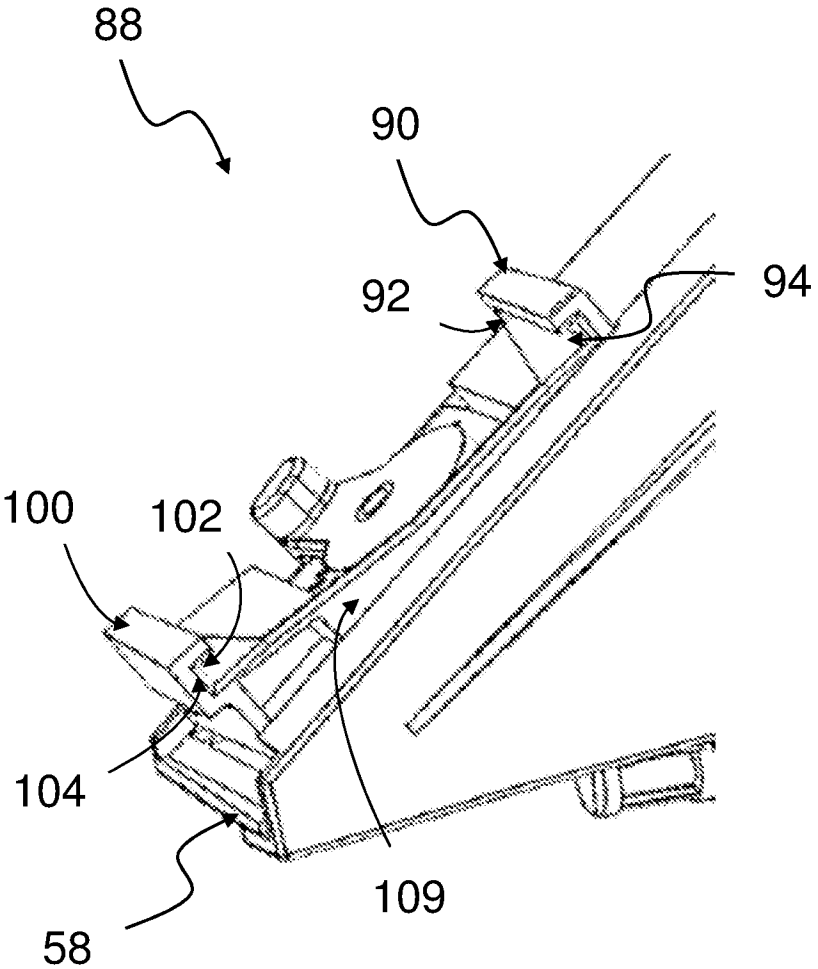
FIG. 10 is an enlarged view of a clip arrangement of the plaster taping apparatus shown in FIG. 4.

With particular reference to FIGS. 10 and 11, at least one of the one or more walls of the compartment 12 of the plaster taping apparatus 10 comprises a clip arrangement 88 for slidably receiving the removable attachment 14 and securing the removable attachment 14 in position relative to the plaster taping apparatus 10. In the embodiment shown, the clip arrangement 88 is provided on the sloping upper wall 32 at or towards the end thereof adjacent the second aperture 58. The clip arrangement 88 comprises a first elongate hook 90 distal the second aperture 58. The first elongate hook 90 creates an elongate recess 92 having an open side 94 and a closed side by virtue of end wall 96. The clip arrangement 88 comprises a first seat 98 adjacent the first hook 90. The clip arrangement 88 comprises a second elongate hook 100 proximal the second aperture 58. The second elongate hook 100 creates an elongate recess 102 having an open side 104 and a closed side by virtue of end wall 106. The clip arrangement 88 comprises a second seat 108 adjacent the second hook 100. The first and second hooks 90, 100 extend transversely at least part way across the sloping upper wall 32, preferably at least half the width across and more preferably at least three quarters across of the width of the sloping upper wall 32. The second hook 100 faces the first hook 90 such that the recess 102 faces the recess 92. The second hook 100 protrudes a greater distance from the surface of the sloping upper wall 32 than the first hook 90. The first seat 98 adjacent the first hook 90 is inclined at a very small angle relative to the surface of the sloping upper wall 32. In preferred embodiments, this angle is 6 degrees, or about 6 degrees. The second seat 108 adjacent the second hook 100 is inclined at a greater angle than the first seat 98 relative to the surface of the sloping upper wall 32. The second seat 108 is angled at about 5 or 6 degrees relative to the first seat 98 and therefore at about 11 or 12 degrees relative to the surface of the sloping upper wall 32. The first seat 98 and the second seat 108 are joined by a v-shaped side wall 109 with an obtuse angle thus creating a clip arrangement 88 having v-shaped base with an obtuse angle. In preferred embodiments, the obtuse angle is 175 degrees, or about 175 degrees.

The first seat 98 and the second seat 108 are separated by a space 110 of sufficient size to accommodate the aperture 66 in the surface of the sloping upper wall 32 and to accommodate the adjustment lever or dial 62. The adjustment lever or dial 62 extends laterally sufficiently such that it is easily accessible by a user when the removable attachment 14 is secured in position and retained by the clip arrangement 88. The surface of the sloping upper wall 32 can comprise a plurality of graduations or markings 112 indicating different predetermined positions for the adjustment lever or dial 62 which adjusts the thickness of plaster mix that will coat the tape.

Figure 12:
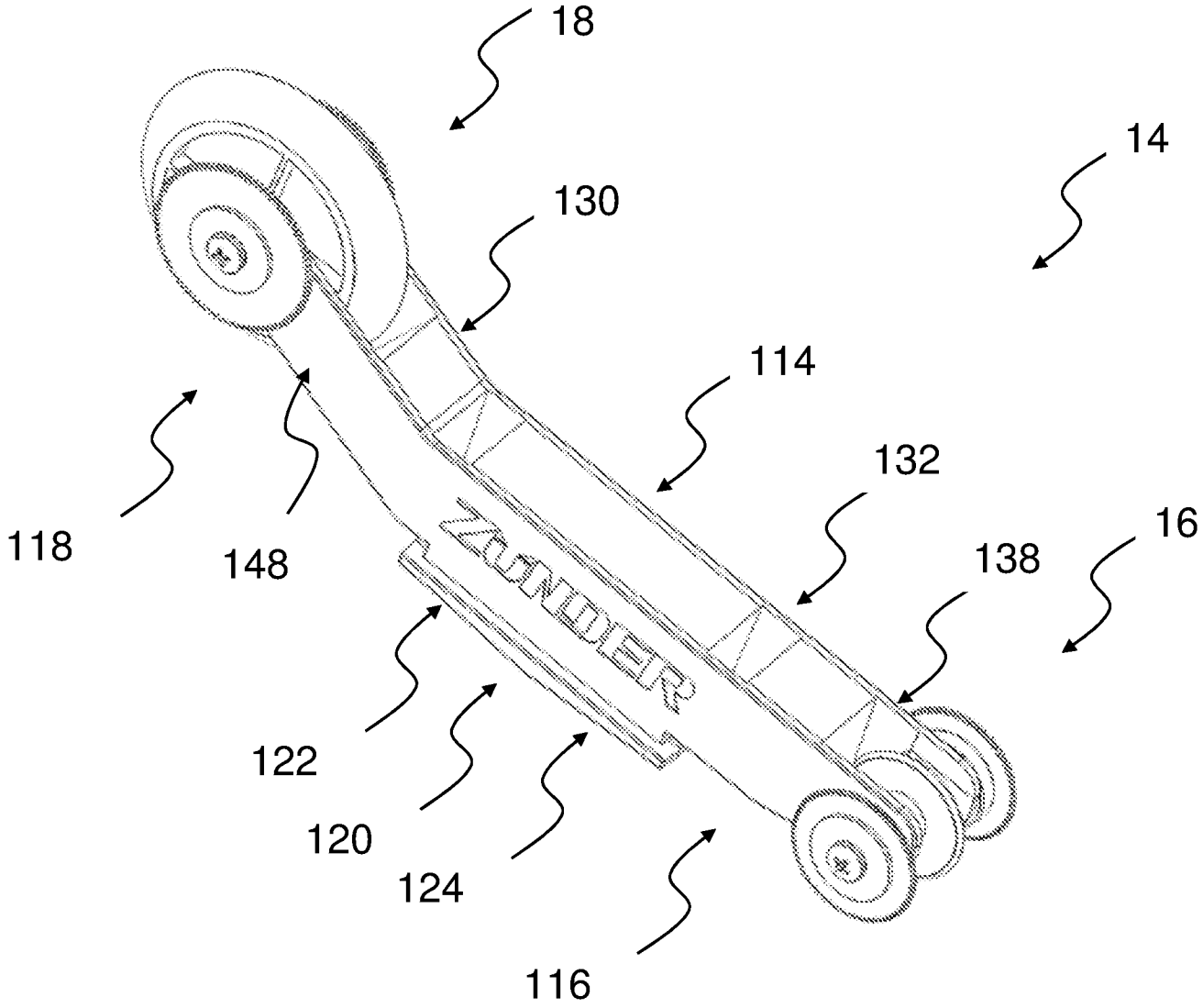
FIG. 12 is a perspective view of the attachment of the plaster taping apparatus shown in FIG. 1.
Figure 13:
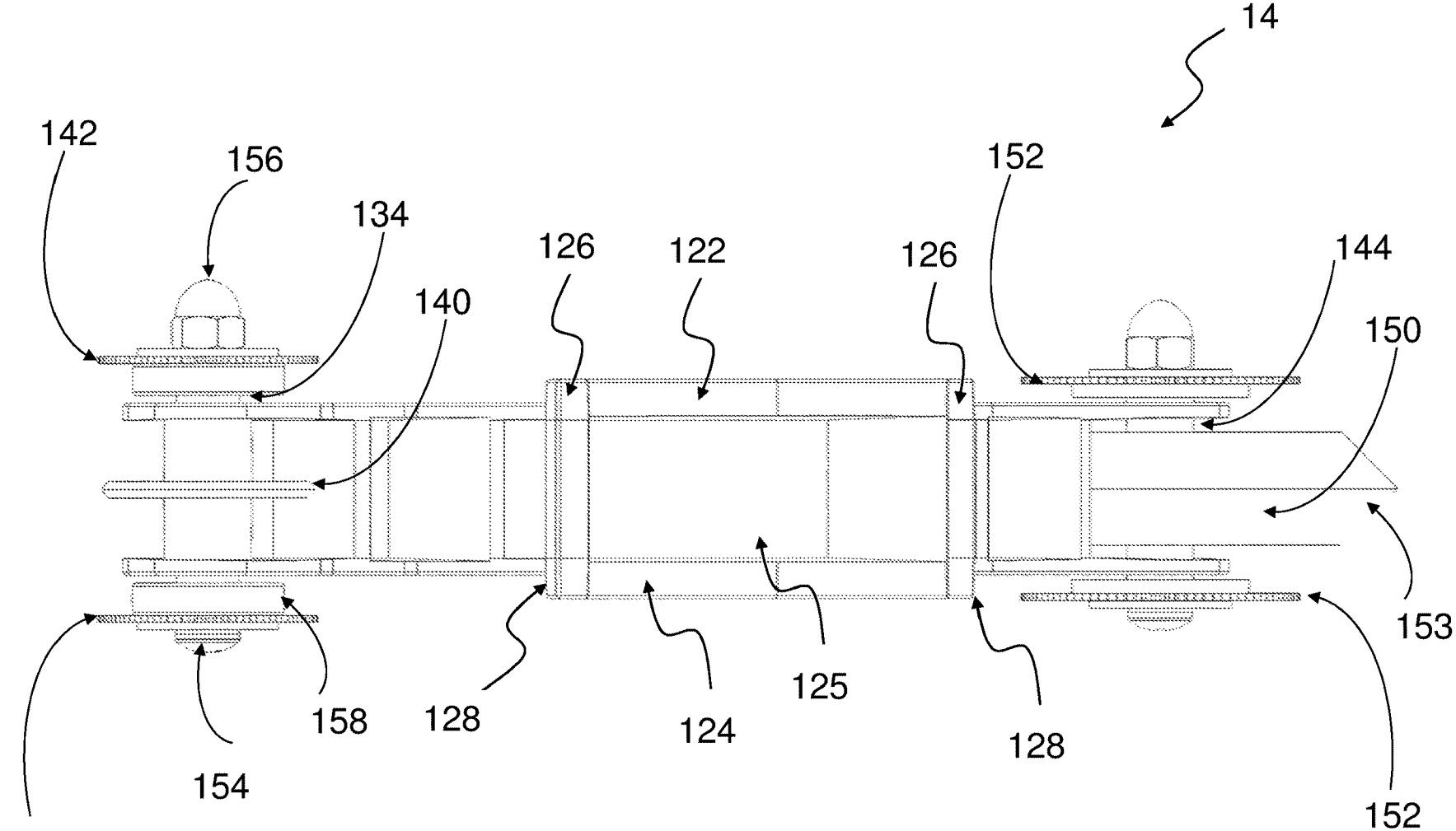
FIG. 13 is an underside view of the attachment shown in FIG. 12.

With additional reference to FIGS. 12 and 13, the removable attachment 14 for the plaster taping apparatus 10 comprises the first wheel arrangement 16 for applying the tape coated with plaster mix to flat joints and the second wheel arrangement 18 for applying the tape coated with plaster mix to internal joints. The removable attachment 14 comprises a body 114 with the first wheel arrangement 16 at or towards a first end 116 of the body 114 and the second wheel arrangement 18 at or towards a second end 118 of the body. The body 114 comprises a mounting member 120 which is slidably received in the clip arrangement 88 of the plaster taping apparatus. The mounting member 120 comprises inclined surfaces 122, 124 that form a V-shape having an obtuse angle such that the mounting member 120 is of a complementary or corresponding shape to the V-shaped base and the v-shaped side wall 109 of the clip arrangement 88 of the plaster taping apparatus 10. In some embodiments, inclined surfaces 122, 124 extend across the full width of the mounting member 120. In other embodiments, the inclined surfaces 122, 124 only occupy a perimeter of the mounting member 120 such that the inclined surfaces 122, 124 are in the form of strips, as shown in FIG. 13. In such embodiments the interior of the mounting member 120 is substantially hollow and comprising one or more cavities 125, thus saving mass and material.

The mounting member 120 comprises a ridge 126 extending transversely along a periphery at each end thereof, transverse to inclined surfaces 122, 124. The ridges 126 and respective edges 128 of the mounting member 120 are slidingly received within respective recesses 92, 102 of the first and second hooks 90, 100 until a side of the mounting member 120 abuts end walls 96, 106. A portion of the inclined surface 122 of the mounting member 120 is supported by the first seat 98 and a portion of the inclined surface 124 is supported by the second seat 108. A height of the seats 98, 108 are such that they provide sufficient clearance between the surface of the sloping upper wall 32 and the inclined surfaces 122, 124 of the mounting member 120 to accommodate the adjustment lever or dial 62.

Figure 2A:
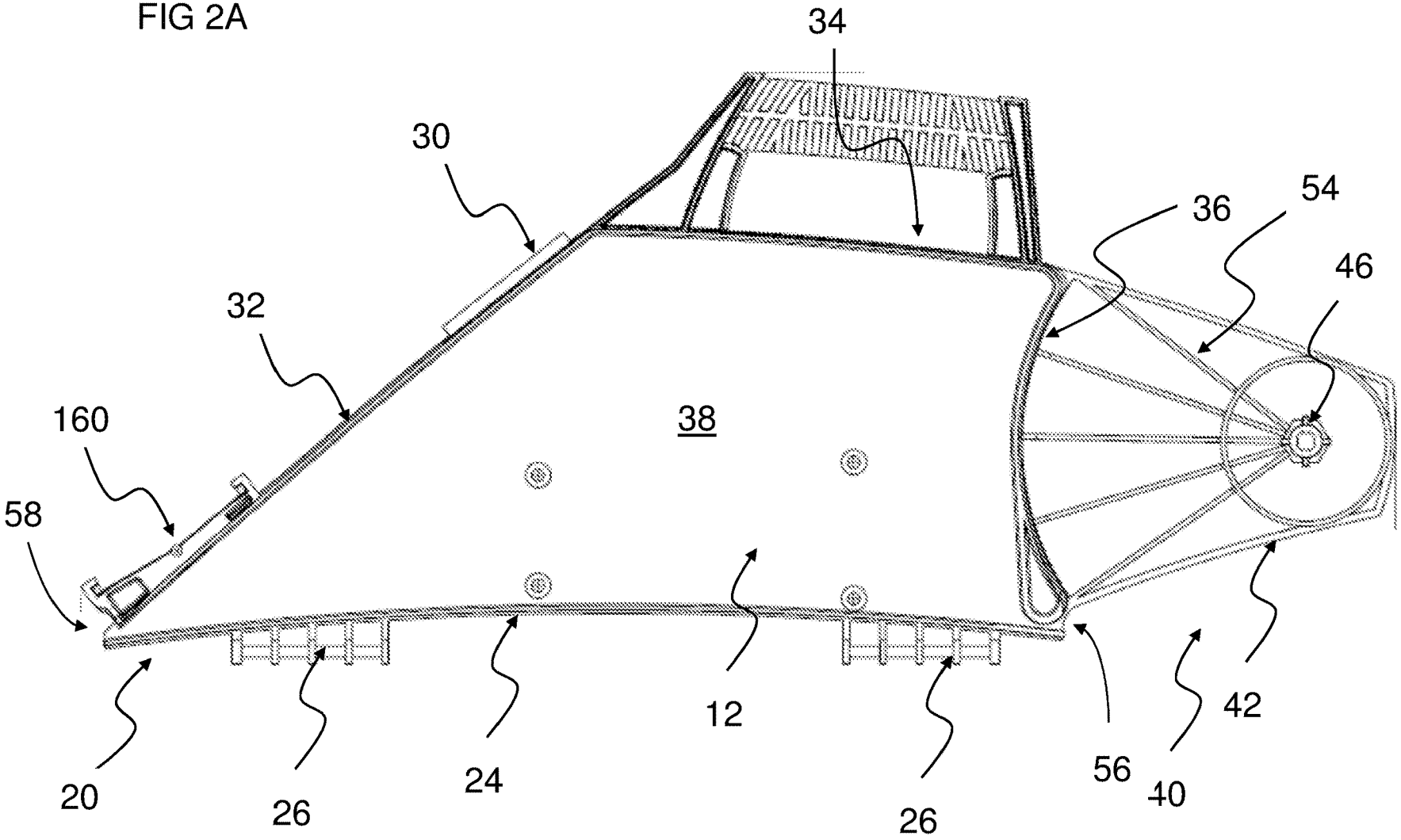
FIG. 2A is a side elevation of a body of the plaster taping apparatus shown in FIG. 1 without a cover and without the attachment.
Figure 6A:
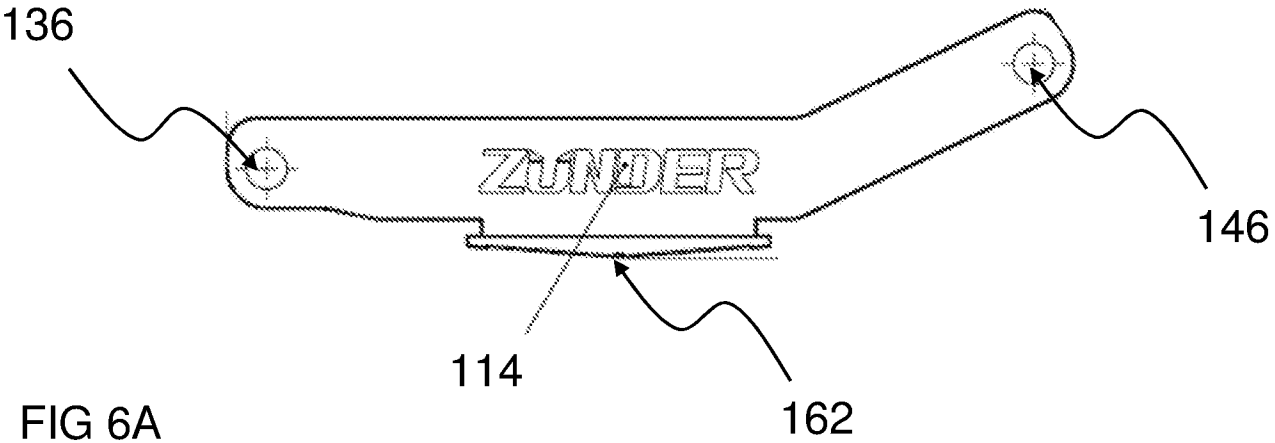
FIG. 6A is a side elevation of the attachment of the plaster taping apparatus shown in FIG. 1 without first or second wheel arrangements.
Figure 9:
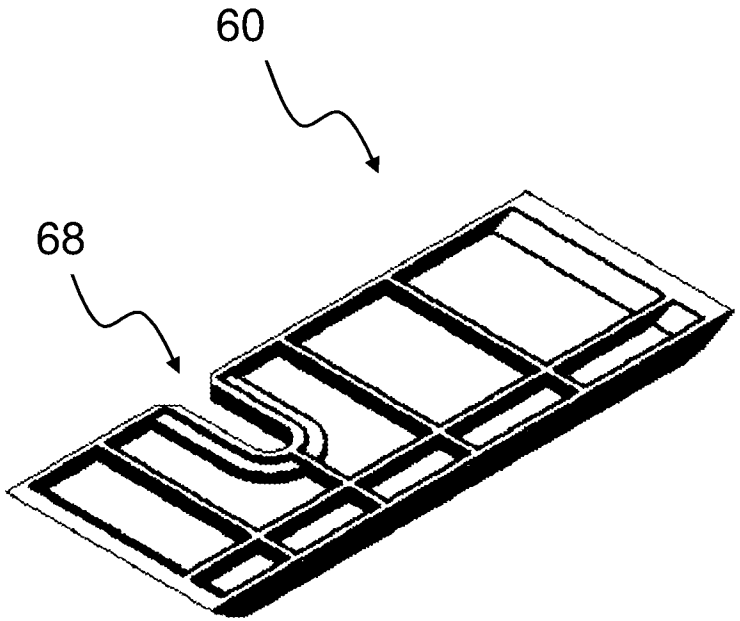
FIG. 9 is a perspective view of the blade shown in FIG. 7.
Figure 8:
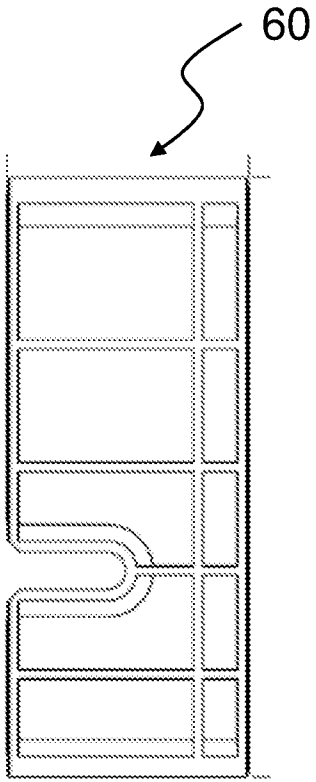
FIG. 8 is a side elevation of the blade shown in FIG. 7.
Figure 7:
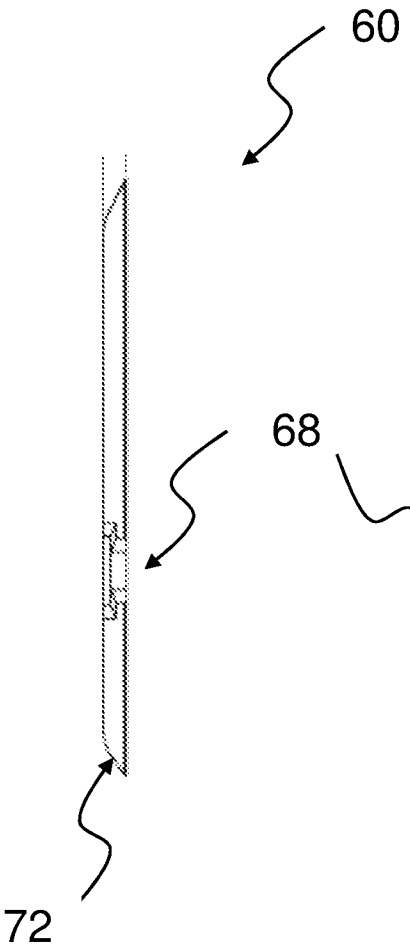
FIG. 7 is a sectional view of the blade shown in FIG. 3.

In preferred embodiments, the clip arrangement 88 includes a bump or projection 160 on the v-shaped side wall 109 at an apex thereof, as shown in FIG. 2A. With particular reference to FIG. 6A, the mounting member 120 of the removable attachment 14 comprises a recess 162 on both sides of the mounting member at an apex of the inclined surfaces 122, 124. The recess 162 has a complementary shape to that of the bump or projection 160 such that when the removable attachment 14 is inserted into the clip arrangement 88, in either orientation, and the removable attachment 14 is in the correct position, the bump or projection 160 is received within and engaged by the recess 162 to assist in retaining the removable attachment 14 in the clip arrangement 88.

The removable attachment 14 is attached to the plaster taping apparatus 10 in a first orientation for applying tape to flat joints and is attached to the plaster taping apparatus in a second orientation for applying tape to internal joints. In preferred embodiments, it will be appreciated that the second orientation is 180 degrees relative to the first orientation. In other words, the attachment 14 is reversible and the orientation of attachment to the plaster taping apparatus 10 is selected according to the type of joint being taped—flat or a corner joint.

The body 114 of the removable attachment 14 comprises a first elongate portion 130 and a second elongate portion 132, wherein the first elongate portion 130 is angled relative to the second elongate portion 132. In a preferred embodiment, the angle between the first and second elongate portions 130, 132 is about 155 degrees.

The first wheel arrangement 16 for applying tape to flat joints comprises an axle 134 rotatably mounted at or towards the first end 116 of the body 114 through apertures 136 in arms 138. The axle 134 supports a central disc 140 and a serrated disc 142 on either side of the central disc 140 and spaced apart from central disc 140. The serrated discs 142 of the first wheel arrangement 16 are of the same or a similar diameter as the central disc 140 for the even application of tape coated with plaster mix to flat joints.

The second wheel arrangement 18 for applying tape to internal corner joints comprises an axle 144 rotatably mounted at or towards the second end 118 of the body 114 through apertures 146 in arms 148. The axle 144 supports a central disc 150 and a serrated disc 152 on either side of the central disc 150 and spaced apart from the central disc 150. The serrated discs 152 of the second wheel arrangement 18 are of a smaller diameter than the central disc 150. The serrated discs 152 of the second wheel arrangement 18 are of a larger diameter than the serrated discs 142 of the first wheel arrangement 16.

A periphery of the central disc 150 of the second wheel arrangement 18 comprises a v-shaped profile to facilitate application of tape coated in plaster taping mix to internal corner joints. The v-shaped profile comprises angled edges 153, which in some embodiments are at 90 degrees to each other. Serrated discs 152 are of a diameter to align with the angled edges 153.

The first and second wheel arrangements 16, 18 are rotatably mounted to the body 114 through apertures 136, 146 in arms 138, 148 via a respective threaded cap screw 154, cap nut 156 and one or more washers or spacers 158.

According to preferred embodiments, the serrated discs 142, 152 of the first and second wheel arrangements 16, 18 are mounted external of the body 114 and in particular outside the arms 138, 148. The central discs 140, 150 of the first and second wheel arrangements 16, 18 are mounted at least partially internally of the body 114 and in particular inside or between the arms 138, 148.

According to preferred embodiments, the body 20, compartment 12 and cover 22 of the plaster taping apparatus 10 are molded from plastics material, such as nylon and in particular glass filed nylon, such as nylon 30 GF+TPE 70A. Components of the plaster taping apparatus 10, such as the hub 44, blade 60, adjustment lever or dial 62 and adjustment pin 70, are also molded from plastics material, such as Acrylonitrile Butadiene Styrene (ABS). However, it will be appreciated that the present invention is not limited to these specific plastics materials and other plastics materials and other materials may also be suitable.

Hence, the plaster taping apparatus 10 and attachment according to embodiments of the present invention address or at least ameliorate at least some of the aforementioned problems of the prior art. For example, the removable attachment 14 provides users with a single attachment that can apply tape coated in plaster taping mix to flat joints and to internal corner joints simply by reversing the orientation of the attachment 14. The attachment 14 easily clips into, and is easily removed from the clip arrangement 88 of the plaster taping apparatus 10 via the mounting member 120 of the attachment 14. The corresponding inclined surfaces 122, 124 and ridges 126 of the mounting member 120 and the seats 98, 108, hooks 90, 100 and recesses 92, 102 of the clip arrangement 88 and the angled portions 130, 132 of the removable attachment 14, ensure that the removable attachment 14 is suitably mounted to the plaster taping apparatus 10 irrespective of whether tape is being applied to flat joints or to internal corner joints. The thickness of plaster mix applied to the tape can be accurately controlled via the blade 60 and the adjustment lever or dial 62. Also, the adjustment lever or dial 62 is easily accessible when the removable attachment 14 is attached to the plaster taping apparatus 10. The plaster taping apparatus 10 and the attachment 14 are lightweight and easy to use, which facilitate the efficient application of tape. The hinged cover 22 allows complete and easy access to the compartment 12 for accurate and easy positioning of the tape through the first and second apertures 56, 58 and within the compartment and for the addition of the plaster taping mix, which reduces spillages and wastage. The cover 22 is also detachable from compartment 12 for easy cleaning of the whole apparatus.

In this specification, the terms "comprise", "comprises", "comprising" or similar terms are intended to mean a non-exclusive inclusion, such that a system, method or apparatus that comprises a list of elements does not include those elements solely, but may well include other elements not listed.

The reference to any prior art in this specification is not, and should not be taken as, an acknowledgement or any form of suggestion that the prior art forms part of the common general knowledge.

Throughout the specification the aim has been to describe the preferred embodiments of the invention without limiting the invention to any one embodiment or specific collection of features. It is to be appreciated by those of skill in the art that various modifications and changes can be made in the particular embodiments exemplified without departing from the scope of the present invention.

The invention claimed is:

1. A plaster taping apparatus comprising:

a compartment for holding plaster taping mix and receiving a supply of tape; and one or more walls of the compartment comprising a clip arrangement thereof for slidably receiving and securing a removable attachment in position relative to the plaster taping apparatus, the removable attachment attachable to the plaster taping apparatus for applying tape comprising the plaster taping mix exiting the compartment to a surface;

wherein the removable attachment comprises:

a body having a first elongate portion and a second elongate portion extending from and angled relative to the first elongate portion;

a first wheel arrangement for applying the tape to flat joints at, or towards a first end of the body at, or towards an end of the first elongate portion; and a second wheel arrangement for applying the tape to internal joints at, or towards a second end of the body at, or towards an end of the second elongate portion;

wherein the body comprises a mounting member which is slidably receivable in the clip arrangement of the plaster taping apparatus in a first orientation to enable only the first wheel arrangement to apply tape to flat joints, and which is slidably receivable in the clip arrangement of the plaster taping apparatus in a second orientation to enable only the second wheel arrangement to apply tape to internal joints;

wherein the mounting member comprises inclined surfaces that form a V-shape having an obtuse angle, the inclined surfaces having a corresponding shape to a V-shaped base of the clip arrangement; and wherein the mounting member comprises a ridge extending transversely to the inclined surfaces along a periphery at each end thereof, wherein the ridges are slidingly received within respective recesses of first and second hooks of the clip arrangement.

2. The plaster taping apparatus of claim 1, further comprising a tape holder coupled to the compartment for holding the supply of the tape.

3. The plaster taping apparatus of claim 2, wherein the tape holder comprises a hub rotatably mounted on an axle for receiving a roll of tape.

4. The plaster taping apparatus of claim 1, wherein the compartment comprises a first aperture for receiving the tape and a second aperture for dispensing the tape comprising the plaster taping mix.

5. The plaster taping apparatus of claim 4, wherein a size of the second aperture is adjustable to vary a thickness of plaster taping mix coating the tape.

6. The plaster taping apparatus of claim 5, wherein the size of the second aperture is adjustable by movement of a blade.

7. The plaster taping apparatus of claim 6, wherein a position of the blade is adjustable according to one or more of the following: within a predetermined range of positions; between a plurality of discrete predetermined positions.

8. The plaster taping apparatus of claim 6, wherein the size of the second aperture is adjustable by movement of an adjustment lever or dial coupled to the blade, wherein the adjustment lever or dial is accessible when the removable attachment is attached to the plaster taping apparatus.

9. The plaster taping apparatus of claim 8, wherein the clip arrangement comprises a first seat and a second seat to support portions of the mounting member to provide sufficient clearance to accommodate the adjustment lever or dial.

10. The plaster taping apparatus of claim 1, further comprising a cover hingedly attached to one or more walls of the compartment for providing access to the compartment and for sealing the compartment.

11. The plaster taping apparatus of claim 10, wherein at least one of the one or more walls of the compartment and/or the cover comprises one or more handles for using and/or carrying the plaster taping apparatus.

12. The plaster taping apparatus of claim 1, wherein the second orientation is 180 degrees relative to the first orientation.

13. The plaster taping apparatus of claim 1, wherein the first wheel arrangement for applying tape to flat joints comprises an axle rotatably mounted at or towards the first end of the body, the axle supporting a central disc and serrated discs on opposite sides of the central disc and spaced apart therefrom.

14. The plaster taping apparatus of claim 13, wherein the serrated discs of the first wheel arrangement are of the same diameter or a similar diameter as the central disc.

15. The plaster taping apparatus of claim 13, wherein the serrated discs of the first wheel arrangement are mounted external of the body and the central disc of the first wheel arrangement is mounted at least partially internally of the body.

16. The plaster taping apparatus of claim 1, wherein the second wheel arrangement for applying tape to internal corner joints comprises an axle rotatably mounted at or towards the second end of the body, the axle supporting a central disc and serrated discs on opposite sides of the central disc and spaced apart therefrom.

17. The plaster taping apparatus of claim 16, wherein the serrated discs of the second wheel arrangement are of a smaller diameter than the central disc.

18. The plaster taping apparatus of claim 16, wherein a periphery of the central disc of the second wheel arrangement comprises a v-shaped profile.

19. The plaster taping apparatus of claim 16, wherein the serrated discs of the second wheel arrangement are mounted external of the body and the central disc of the second wheel arrangement is mounted at least partially internally of the body.

20. A removable attachment for a plaster taping apparatus, the removable attachment comprising;

a body having a first elongate portion and a second elongate portion extending from and angled relative to the first elongate portion;

a first wheel arrangement for applying tape to flat joints at, or towards a first end of the body at, or towards an end of the first elongate portion; and a second wheel arrangement for applying tape to internal joints at, or towards a second end of the body at, or towards an end of the second elongate portion;

wherein the body comprises a mounting member which is slidably receivable in a clip arrangement on a wall of the plaster taping apparatus in a first orientation to enable only the first wheel arrangement to apply tape to flat joints, and which is slidably receivable in the clip arrangement of the plaster taping apparatus in a second orientation to enable only the second wheel arrangement to apply tape to internal joints;

wherein the mounting member comprises inclined surfaces that form a V-shape having an obtuse angle, the inclined surfaces having a corresponding shape to a V-shaped base of the clip arrangement; and wherein the mounting member comprises a ridge extending transversely to the inclined surfaces along a periphery at each end thereof, wherein the ridges are slidingly received within respective recesses of first and second hooks of the clip arrangement.

21. The removable attachment of claim 20, wherein the second orientation is 180 degrees relative to the first orientation.

22. The removable attachment of claim 20, wherein the first wheel arrangement for applying tape to flat joints comprises an axle rotatably mounted at, or towards the first end of the body, the axle supporting a central disc and serrated discs on opposite sides of the central disc and spaced apart therefrom.

23. The removable attachment of claim 22, wherein the serrated discs of the first wheel arrangement are of the same diameter or a similar diameter as the central disc.

24. The removable attachment of claim 22, wherein the serrated discs of the first wheel arrangement are mounted external of the body and the central disc of the first wheel arrangement is mounted at least partially internally of the body.

25. The removable attachment of claim 20, wherein the second wheel arrangement for applying tape to internal corner joints comprises an axle rotatably mounted at, or towards the second end of the body, the axle supporting a central disc and serrated discs on opposite sides of the central disc and spaced apart therefrom.

26. The removable attachment of claim 25, wherein the serrated discs of the second wheel arrangement are of a smaller diameter than the central disc.

27. The removable attachment of claim 25, wherein a periphery of the central disc of the second wheel arrangement comprises a v-shaped profile.

28. The removable attachment of claim 25, wherein the serrated discs of the second wheel arrangement are mounted external of the body and the central disc of the second wheel arrangement is mounted at least partially internally of the body.

* * * * *